United States Patent [19]

Beach et al.

[11] Patent Number: 4,673,469

[45] Date of Patent: Jun. 16, 1987

[54] METHOD OF PLATING PLASTICS

[75] Inventors: Sidney C. Beach, Parma; Jack D. Fellman, Brunswick, both of Ohio

[73] Assignee: McGean-Rohco, Inc., Cleveland, Ohio

[21] Appl. No.: 755,961

[22] Filed: Jul. 17, 1985

Related U.S. Application Data

[63] Continuation of Ser. No. 619,681, Jun. 8, 1984, abandoned, which is a continuation of Ser. No. 345,316, Feb. 3, 1982, abandoned, which is a continuation of Ser. No. 112,347, Jan. 15, 1980, abandoned.

[51] Int. Cl.[4] ..... C25D 5/10

[52] U.S. Cl. ..... 204/38.4; 204/20; 204/30; 204/40; 204/52.1

[58] Field of Search ..... 204/20, 30, 38.4, 52 R, 204/18.1, 40

[56] References Cited

U.S. PATENT DOCUMENTS

| | | | |
|---|---|---|---|
| 3,328,273 | 6/1967 | Cruetz et al. | 204/52 R |
| 3,445,350 | 5/1969 | Klinger et al. | 204/30 |
| 3,567,594 | 3/1971 | Wells | 204/20 |
| 3,769,179 | 10/1973 | Durose et al. | 204/52 R |
| 4,036,711 | 7/1977 | Kardos et al. | 204/52 R |
| 4,048,043 | 9/1977 | Bick et al. | 204/224 R |
| 4,110,176 | 8/1978 | Cruetz et al. | 204/52 R |
| 4,181,582 | 1/1980 | Dahms | 204/52 R |
| 4,374,709 | 2/1983 | Combs | 204/38.4 |

OTHER PUBLICATIONS

*Metal Finishing,* 49th Guidebook-Directory Issue 1981, vol. 79, No. 1A, pp. 244-245, Jan. 1981.

Saubestre, E. B., "Theory and Practice of Plating on Plastics", paper No. 690090 presented at the International Automotive Engineering Congress, Detroit, Mich., 1969.

*Encyclopedia of Polymer Sciences and Technology,* "Metallizing", vol. 8, ppl. 661-662, 1968.

Combs, D. J., "Use of Acid Copper for Electroplating Plastic", *Plating and Surface Finishing*, vol. 68, No. 7, 1981, pp. 58-61.

Saubestre, E. B., "Plastics", *Electroplating Engineering Handbook, 3d Edition,* Van Nostrand Rheingold Co., New York, 1971, pp. 212-213.

*Primary Examiner*—John F. Niebling

*Assistant Examiner*—B. J. Boggs, Jr.

*Attorney, Agent, or Firm*—Fay, Sharpe, Fagan, Minnich & McKee

[57] ABSTRACT

A method is provided for electrodepositing a layer of copper on a plastic substrate which method comprises: positioning the plastic substrate on a supporting member, with the supporting member being in contact at a plurality of spaced apart points with the substrate for the passage of electrical current therebetween; electrolessly depositing a thin layer of metal selected from the group consisting of copper, nickel, cobalt and mixtures thereof on a surface of the plastic substrate; positioning the supported substrate in an electroplating bath including from about 10.0 to about 45.0 g/l of copper ions, at least one acid selected from the group consisting of sulfuric acid, fluoroboric acid and sulfamic acid, with the acid being present in an amount sufficient to cause the electroplating bath to have a conductivity ranging from about 0.40 to about 0.60 mhos and from about 30 to about 150 mg/l of chloride ions; and passing electrical current through the bath so as to cause a layer of copper to be electrolytically deposited over the layer of electrolessly deposited metal.

9 Claims, No Drawings

METHOD OF PLATING PLASTICS

This application is a continuation of application Ser. No. 619,681, filed 6/8/84 now abandoned, which in turn is a continuation of application Ser. No. 345,316, 2/3/82 now abandoned which in turn is a continuation of application Ser. No. 112,347 filed 1-15-80, now abandoned.

BACKGROUND OF THE INVENTION

The present invention relates to a method for electrolytically depositing a thin conductive layer of copper on a nonconductive substrate. More specifically, it concerns a method for adherently depositing a thin continuous conductive layer of copper over a layer of electroless metal which has been deposited on the surface of a plastic substrate.

The art of electroplating plastics is relatively well known. For example, chemical processes are commercially available for activating the surface of plastics so that they will conduct electrical current, thereby making electroplating by conventional methods possible. However, even with many improvements in chemical processes and electroplating techniques, there are still conditions which arise in the practice of processing plastic parts which can cause a high percentage of unacceptable parts due to plating defects. One very common defect is a lack of metallic coating (or a void) in the areas surrounding the points where electrical contact is made with the article being plated. This condition is commonly called "burn-off" by those in the plastic electroplating industry. It has been demonstrated that burn-off is caused by inadequate conductivity between the very thin electroless deposit (nickel or copper) that is first applied to the activated plastic surface and the contact points of the racking fixture. This condition becomes more severe as the area of the part to be plated increases, along with its increased number of contact points. It is understandable that, as the area of the part increases, the amperage necessary for adequate coverage of the electrodeposited coating must also be increased. This can only be achieved by an increase in electrical potential (voltage). Therefore, the resistance at each contact becomes increasingly critical as the voltage required for deposition of the first metallic coating increases. The points of higher resistance generate so much heat that the contact bridge is quickly burned through if additional metal is not immediately deposited to reinforce the current-carrying capacity. As contact is lost, the current load is then shifted to the other contact points and burn-off may then become a chain reaction continuing until there is a complete loss of electrical contact, provided sufficient bridging has not occurred by that time. However, even the loss of a single contact point will generally result in rejected work. In such cases, the metallic electroless deposit that surrounds the barren, nonconductive burn-off area becomes bipolar to the highly negative rack contact, and the coating that may have occurred in that area is anodically dissolved with the final result being a much larger area that is void of any metallic coating. It is also common knowledge that areas of high stress, created during the molding of the plastic parts, are difficult to etch, resulting in thin, electroless deposits which are incapable of conducting the surge of current when the potential is applied to begin electroplating and therefore a contact point in any such area will generally result in electrical failure.

Prior art techniques, in general, suffer from the following deficiencies: (a) their susceptability to burn-off and the lifting off of the plate from the plastic substrate; (b) the high cost of operation because of rejected parts or lost production; (c) the higher cost of operation when using a nickel strike instead of a copper strike; (d) the poor throwing power and low current density coverage of the electroless metal deposits by nickel and copper strikes, particularly around and under the contacts; (e) the coarse grain structure and objectionable appearance of deposits from the strike baths which do not contain additives; and (f) the high voltage requirements needed for strikes of the present art in order to achieve metal deposition in areas of extreme low current densities.

Accordingly, it is the main object of the invention to provide an improved process for the electroplating of plastic parts.

A further object of the invention is to provide an improved process for the electroplating of plastic parts which eliminates the common problem of "burn-off" which results in a large number of rejected parts in production installations.

A still further object of the invention is to provide a process for electroplating plastics which includes a novel copper strike with both superior throwing power and coverage so as to form a satisfactory deposit in the recessed areas and around contact points.

Another object of the invention is to provide additives for the copper strike which influence the characteristics of the copper deposit. This includes the production of a bright, fine-grained deposit with excellent ductility and low stress.

A still further object of the invention is to produce a copper strike that will give the desired low current density coverage and protection of thin electroless deposits at voltages below those which produce "burn-off".

These and other objects of the invention will become apparent to those skilled in the art from a reading of the following specification and claims.

SUMMARY OF THE INVENTION

In one aspect, the present invention concerns a method for electrodepositing a layer of copper on a plastic substrate which method comprises:

positioning the plastic substrate on a supporting member, with the supporting member being in contact at a plurality of spaced apart points with the substrate for the passage of electrical current therebetween;

electrolessly depositing a thin layer of metal selected from the group consisting of copper, nickel, cobalt and mixtures thereof on a surface of the plastic substrate;

positioning the supported substrate in an electroplating bath including from about 10.0 to about 45.0 g/l of copper ions, at least one acid selected from the group consisting of sulfuric acid, fluoroboric acid and sulfamic acid, with the acid being present in an amount sufficient to cause the electroplating bath to have a conductivity ranging from about 0.40 to about 0.60 mhos, and from about 30 to about 150 mg/l of chloride ions; and passing electrical current through the bath so as to cause a layer of copper to electrolytically deposited over the layer of electrolessly deposited metal.

In another aspect, the present invention concerns a bath for use in the electrodeposition of a layer of copper on a plastic substrate having applied to a surface thereof a layer of electrolessly deposited metal which substrate is positioned on a supporting member at a plurality of spaced apart points for the passage of electrical current therebetween while preventing burn-off of the layer of electroless metal at the points where it is in contact with said supporting member, which bath includes from about 10.0 to about 45.0 g/l of copper ions, at least one acid selected from the group consisting of sulfuric acid, fluoroboric acid and sulfamic acid, with the acid being present in an amount sufficient to cause the electroplating bath to have a conductivity ranging from about 0.40 to about 0.60 mhos, and from about 30 to about 150 mg/l of chloride ions.

DESCRIPTION OF THE PREFERRED EMBODIMENTS OF THE INVENTION

While the present invention is directed to an improved process for electrodepositing copper on a non-conductive plastic substrate, the specific type of plastic utilized is not critical and therefore it will not be discussed herein in detail. Suffice it to say that such plastics include ABS, polypropylene, polyethylene, polyester resin impregnate fiberglass and a myrid of other common plastics.

The technique for electrolessly depositing metal on a plastic substrate is known in the art and can be described as set forth in the following sequence of steps.

A. Pre-Etch (optional)—Usually, a non-aqueous solvent-based solution is applied to the plastic to be plated. This solution selectively and chemically reacts with the polymer system in the surface layers of the plastic. It is usually required only in plastics which are less common and/or more difficult to activate.

B. Etch—An etch solution is applied to the plastic article. This etchant chemically reacts with the surface of the plastic, introducing microscopic pores or voids. Such solutions are usually strongly acidic with the most prevalent being chromic acid, or a mixture of chromic acid and sulfuric acid. Wetting agents are commonly used to aid in the wetting of the surface during the etch operation. The pores act as sites for catalyst absorption during subsequent steps.

C. Neutralizer—A neutralizer is then applied to the etched plastic. This solution serves two functions: (1) it aids in rinsing the surface free of the powerful oxidizing $Cr^{+6}$ ions, and (2) it chemically reduces $Cr^{+6}$ ions to the relatively inert $Cr^{+3}$ ions in the pores of the plastic. These ions may be trapped in the pores on the surface of the plastic. Common materials which act as neutralizers are mixtures of complexing agents, such as polyamines, and reducing agents, such as hydroxylamine and bisulfites.

D. Catalyst or Activator—The critical step in making plastic conductive is the embedding of a sufficient number of particles of an active metal in the surface of the plastic. This may be accomplished in a two-step procedure where parts are first processed through a solution of stannous chloride, followed by a solution of palladium chloride or (more commonly) a one-step procedure where the tin and palladium chlorides are combined in one bath.

E. Accelerator—An accelerator is then applied to the activated surface of the plastic. A typical bath which has traditionally been either alkaline or acidic and, when included in the plating cycle, causes rapid initiation of deposition of the electroless metal. This allows for a faster rate of processing parts and has, in many cases, improved the adhesion of the metallic coating. More recently, accelerators are of a strong reducing nature, such as hydrogen peroxide in sulfuric acid, which may function to expose or activate more palladium sites.

F. Electroless Metal Deposition—Copper and nickel are the metals most commonly plated on the freshly deposited palladium sites on the surface of the plastic. Neither electroless copper nor electroless nickel baths are autocatalytic in nature. This is to say, they will not initiate the chemical reduction reaction necessary to deposit the metal on the plastic. They require a catalyst to initiate the plating reaction which then becomes continuous as long as there is contact with the solution. The fresh metallic palladium surface acts as the catalyst for the chemical reduction reaction of metal islands are formed on all the active palladium sites. The freshly deposited copper or nickel will then act as the catalyst to continue the deposition which eventually produces bridging between all the islands until the entire surface of the plastic is covered with the metal. These islands of palladium also serve as anchors for the metallic coating to the plastic and are responsible for the attractive force which holds the plate to the surface.

Electroless copper baths usually consist of a source of copper ions, such as copper sulfate, complexing agents (such as EDTA or tartrate to keep the copper ions in solution on the alkaline side), sodium hydroxide, a reducing agent (such as formaldehyde which is reactive only on the alkaline side), and stabilizers (such as cyanide, metal cyanide complexes, and organo-sulfur compounds), all of which serve to "tie-up" the trace amounts of cuprous ions present in the solution to prevent them from being further reduced and spontaneously precipitating copper metal, thus decomposing the bath.

Electroless nickel baths usually contain a source of nickel ions (such as nickel chloride), complexing agents (such as citrate to keep the nickel ions in solution at an alkaline pH), ammonium hydroxide, and a weak reducing agent (such as sodium hypophosphite). In general, electroless nickel baths are more stable and a great deal more work has been done on them than on any of the other metals, including copper.

Electroless cobalt is sometimes used in place of nickel to plate the surface of a plastic substrate. As cobalt and nickel have somewhat similar chemical and physical properties, the primary difference between the respective baths resides in the specific metal ion present.

In the usual practice, the plastic substrate is positioned on a supporting apparatus or rack which is provided with a plurality of fingers or protrusions that contact the surface of the plastic substrate and thereafter electroless metal is deposited on the substrate by conventional techniques. As the tips or ends of these protrusions or fingers are conductive, electrical current can be passed between them and the metal coated substrate so as to cause metal (copper) to be electrolytically deposited on the substrate.

With regard to the foregoing technique, it should be noted that the electroless layer of metal can be deposited on the plastic substrate before it is positioned on the supporting member and that in such an arrangement the benefits of the present invention are still realized.

It has been found that unexpected results are achieved with the use of the novel copper strike of the invention in conjunction with the commonly pre-plate cycle for metallizing plastic parts. The composition of the copper strike bath can be characterized as follows:

Copper, as metal: 10.0–45.0 g/l,
$CuSO_4.5H_2O$: 45–120 g/l,
$H_2SO_4$: 150–310 g/l,
Acidity: 3.5–6.0N,
Chloride Ion: 30–150 mg/l,
Temperature: 20°–45° C.

When it is desired to produce a copper layer having improved ductility and excellent grain refinement, the following additives are used in combination with the above-described bath:

Sulfonated sulfur-containing compound(s): 1–100 mg/l,
Non-ionic wetting agent: 0.1–0.5 g/l.

The use of a bath of the above composition at this step of the process provides an instantaneous protective coating over the more delicate electroless copper or nickel deposits, particularly in low current density areas. Copper deposits from this strike bath have excellent conductivity and permit the plastic part to be further processed without causing plating defects due to the increasingly higher voltages that are required by the subsequent decorative acid copper, bright nickel, and chromium plating baths.

It is believed that the explanation for this unexpected result is due to a combination of factors, all of which are related, to achieve a greater degree of polarization in the high current density areas while improving the bath conductivity which, in turn, increases the low current density coverage or throwing power of the solution. The reduced voltage, i.e., reduced power required for plating in this method reduces the heat at the support points so that burn-off does not occur.

The prior art has taught that for maximum effectiveness plating baths should be near saturation in copper ions to prevent burning in the higher current densities. Baths of this type suffer from very poor throwing coverage in deeply recessed areas so that very little copper is plated in the low current density area under and around the contact points. The preferred copper ion concentrations of the instant invention (10.0 to 45.0 g/l) are significantly lower than prior art and will have a greater tendency to burn at high current densities, but not at those current densities commonly used in present plating operations. The improved throwing power from the high current density polarization and increased conductivity is much more significant than the slight loss of high current density cathode efficiency.

The relatively high concentration of sulfuric acid (150 to 310 g/l $H_2SO_4$) in the bath provides adequate conductivity so that copper can be plated, even in the low current density areas, with relatively low power requirements. This lower wattage (power) requirement produces the improved results in production installations with regard to "burn-off". Prior art copper baths vary from a nearly neutral pH (low acidity) to as much as 1.5N in sulfuric acid. This is the maximum concentration of sulfuric acid which can be used in order to prevent crystallization of the copper sulfate due to the "common ion" mechanism. These prior art baths can not provide the necessary conductivity to give plating or coverage in the low current density area at reduced potentials. Sulfuric acid can be used in concentrations as high as 6.0N in the instant invention (ranging from 3.5 to 6.0N) which significantly improves the conductivity of the bath over the prior art.

In practice, while sulfuric acid is preferred, other acids such as fluoroboric acid and sulfamic acid can also be used to regulate the conductivity of the plating bath with the criterion being that the selected acid is used in an amount sufficient to cause the conductivity of the bath to be such that a layer of electrodeposited metal can be plated over the electroless metal at the points where the supporting member electrically contacts the substrate without experiencing burn-off. That is, the selected acid is used in an amount sufficient to cause the bath to have a conductivity ranging from about 0.40 to about 0.60 mhos.

Chloride ion is essential to the performance of the bath in the concentrations specified. Its role in the deposition of copper is believed to be in the formation of copper chloride complexes in the cathode film as copper is being reduced from the divalent to metallic state. The chloride ion should be present in an amount ranging from 30.0 to 150.0 mg/l. The preferred source of chloride ion is hydrochloric acid. However, other sources of chloride ions may also be employed in the practice of the invention.

Additives are utilized in connection with the instant invention to provide ductility and grain refinement of the copper deposit. It is most difficult to find organic additives which function as brighteners and are stable in these strong sulfuric acid solutions. Those preferred for the instant invention include sulfonated sulfur-containing compounds which are known and used in the electroplating art as brighteners. Such compounds are illustrated by the following structural formula: $HO_3S—R—SH$, $HO_3S—R—S—S—R—SO_3H$ (where R $=C_1$-$C_6$) and $HO_3S—Ar—S—S—Ar—SO_3H$ (where Ar=phenyl or naphthyl). Typical of such compounds are the sulfurized sulfonated aromatic hydrocarbons, as taught in U.S. Pat. No. 2,424,887; sulfonated aryl sulfides and disulfides as taught in U.S. Pat No. 3,267,010; and sulfonated aliphatic disulfides as taught in U.S. Pat. No. 3,328,273.

Non-ionic wetting agents generically described as alkoxylated aliphatic or aromatic hydroxy compounds are used in conjunction with the sulfur-containing compounds, since they function in a synergistic manner to impart the desired physical properties to the deposits and aid in surface wetting and ion migration into recessed areas. Such compounds are disclosed in U.S. Pat. No. 3,328,273. These compounds can be illustrated by the following structural formula: $R—(CH_2CH_2O)_nH$, where $R=C_2H_5O—$, $HOC_2H_4O—$,

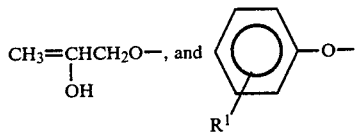

(where $R^1=C_8-C_{12}$).

The practice of the invention may best be illustrated by the following processing cycle and examples:

A two-liter battery jar, equipped with air agitation and 3"×6" copper or nickel anodes, was used at the test cell for comparing the performance of the strike baths. All panels were plated at 40 ASF (3.6 amps) and the corresponding voltage required was recorded. Test panels were 3"×3½" plaques of plateablegrade ABS plastic. ABS plaques were positioned on a rack having a plurality of protrusions or fingers which served to permit current to flow between them and the plaques to cause copper to be electrolytically deposited thereon.

STANDARD PROCESSING CYCLE

1. Etch—7 minutes—mixed chromic acid, sulfuric acid solution, 50° C.
2. Rinse—Two counterflowing cold water rinses. The color of the first rinse becomes yellow quite rapidly from the film of $Cr^{+6}$ adhering to the panel.
3. Neutralizer—2 minutes—solution of acid salts and hydroxylamine hydrochloride.
4. Rinse—Two counterflowing cold water rinses.
5. Catalyst—2 minutes—solution of mixed palladium-tin chlorides.
6. Rinse—Two counterflowing cold water rinses.
7. Accelerator—2 minutes—solution of hydrogen peroxide in dilute sulfuric acid.
8. Rinse—Two counterflowing cold water rinses.
9. Electroless nickel or copper plate—7 minutes.
10. Rinse—Two counterflowing cold water rinses.
11. Dip in 0.03N sulfuric acid.

EXAMPLE I

Steps (1) through (11) of the Processing Cycle were followed, using an electroless nickel bath in Step (9) which contained nickel sulfate, nickel chloride, ammonium hydroxide, sodium citrate, and sodium hypophosphite. No strike deposit was used.

12. A decorative copper electroplate was then applied to the substrate (30 minutes at 40 ASF (1.6 volts)).

Decorative copper bath composition:
$CuSO_4.5H_2O$: 225 grams/liter,
$H_2SO_4$: 60 grams/liter,
HCl: 50 milligrams/liter,
Temperature: 25° C.,
Cuflex MU: 5 ml/l,
Cuflex LP: 1 ml/l.

Results

The test panel had bright copper plate over most of the front and back, but had dark spots where the surface of the plastic was exposed because copper had not plated. This occurred predominantly around points where the rack tips made contact with the plastic panel. This simulates a rejected part from a production installation.

EXAMPLE II

Steps (1) through (11) of the Processing Cycle were repeated.

12. A nickel strike was then applied to the substrate (3 minutes, at 40 ASF (3.1 volts)).

The bath consisted of:
$NiSO_4.7H_2O$: 300 grams/liter,
$NiCl_2.7H_2O$: 60 grams/liter,
$H_3BO_3$: 45 grams/liter,
pH: 4.0,
Temperature 60° C.

13. A decorative copper electroplate was then applied to the substrate (30 minutes, at 40 ASF (1.6 volts), as in Example I).

Results:

As in Example I, there were dark, bare spots of plastic around contact points. The coverage of the panel by the nickel strike was not sufficient to protect the electroless nickel deposit.

EXAMPLE III

Steps (1) through (11) of the Processing Cycle were repeated.

12. A nickel strike was applied to the substrate (3 minutes, at 40 ASF (2.4 volts)).

The bath consisted of:
$NiCl_2.7H_2O$: 200 grams/liter,
$H_3BO_3$: 45 grams/liter,
pH: 4.0,
Temperature: 55° C.

13. A decorative copper electroplate was then applied to the substrate (30 minutes, at 40 ASF (1.6 volts), as in Example I).

Results:

Same as Example I. The all-chloride nickel strike did not provide the coverage and protection to the electroless nickel deposit to prevent "burn-off".

EXAMPLE IV

Steps (1) through (8) of the Processing Cycle were repeated.

9. Electroless copper plate—7 minutes—bath consisted of copper sulfate, sodium hydroxide, EDTA, and formaldehyde.

10. Rinsed in two overflowing cold water rinses.

11. Dip in 0.03N sulfuric acid.

12. A decorative copper electroplate was then applied to the substrate (30 minutes, at 40 ASF (1.6 volts), as in Example I).

Results:

Same as Example I.

EXAMPLE V

Steps (1) through (11) of Example IV were repeated.

12. A nickel strike was applied to the substrate (3 minutes, at 40 ASF (3.1 volts)—same bath as for Step (12) of Example II).

13. A decorative copper electroplate was applied to the substrate (30 minutes, at 40 ASF (1.6 volts), as in Example I).

Results:

Same as Example I.

EXAMPLE VI

Steps (1) through (11) of Example IV were repeated.

12. A nickel strike was applied to the substrate (3 minutes, at 40 ASF (2.4 volts)-same bath as in Example III, Step (12)).

13. A decorative copper electroplate was applied to the substrate (30 minutes, at 40 ASF (1.6 volts), as in Example I).

Results:

Same as in Example I.

EXAMPLE VII

Steps (1) through (11) of the Processing Cycle were repeated.

12. A copper strike was applied to the substrate (3 minutes, at 40 ASF (1.6 volts)).

The bath consisted of:

$CuSO_4.5H_2O$: 225 grams/liter, $H_2SO_4$: 60 grams/liter,

HCl: 50 milligrams/liter,

Temperature: 25° C.

13. A decorative copper electroplate was applied to the substrate (30 minutes, at 40 ASF (1.6 volts), as in Example I).

Results:

Same as in Example I.

EXAMPLE VIII

Steps (1) through (11) of Example IV were repeated.

12. A copper strike was applied to the substrate (3 minutes, at 40 ASF (1.6 volts), same bath as in Step (12) of Example VII).

13. A decorative copper electroplate was applied to the substrate (30 minutes, at 40 ASF (1.6 volts), as in Example I).

Results:

Same as in Example I.

SUMMARY OF RESULTS OF EXAMPLES I THROUGH VIII

Examples I through VIII demonstrate the phenomenon of burn-off in the various combinations of electroless nickel and copper with/without the use of nickel strike and copper strike, followed by bright decorative copper plating. In each case, the power required for plating was high enough to cause burnoff in one or more areas.

In the following set forth Examples, the following bath of the invention was utilized, except in certain cases the additives were not included.

Copper, as metal: 22.5 g/l, $CuSO_4.5H_2O$: 90 g/l, $H_2SO_4$: 210 g/l,

Acidity: 4.3 N,

Chloride Ion: 50 mg/l, (additive) Disulfopropyl Disulfide: 5 mg/l, (additive) Polyethylene Glycol (m. wt. approx. 6000): 0.3 g/l, Temperature: 25° C.

EXAMPLE IX

Steps (1) through (11) of the Processing Cycle were repeated.

12. Copper strike in the bath of the instant invention with no additives—3 minutes, at 40 ASF (0.8 volts).

13. Copper electroplate—30 minutes, at 40 ASF (1.6 volts), same bath as in Example I, Step (12).

Results:

The test panel after the strike bath of Step (12) had a dull, uniform copper plate covering both sides with no areas of skip-plate. The panel was completely covered, even around the contacts. Bright copper plating (Step 13) produced a test panel which was completely covered with a bright decorative coating.

EXAMPLE X

Steps (1) through (11) of Example IV were repeated.

12. Copper strike in the bath of the instant invention with no additives—3 minutes, at 40 ASF (0.8 volts).

13. Copper electroplate—30 minutes, at 40 ASF (1.6 volts), same as bath as in Example I, Step (12).

Results:

Same as in Example IX.

EXAMPLE XI

Steps (1) through (11) of the Processing Cycle were repeated.

12. A copper plate was applied using a strike bath of the instant invention (3 minutes, at 40 ASF (0.8 volts)).

13. A decorative copper electroplate was applied to the substrate (30 minutes, at 40 ASF (1.6 volts), same bath as in Example I, Step (12)).

Results:

The test panel after the strike bath of Step (12) had a bright, uniform copper plate covering both sides with no areas of skip-plate. It was completely covered, even around the rack contacts. Bright copper, Step (13), produced a panel with greater brightness and depth of color.

EXAMPLE XII

Example XI was repeated except that the copper strike in Step (12) was plated at 60 ASF (1.0 volts), rather than at 40 ASF.

Results:

Same as Example XI.

EXAMPLE XIII

Steps (1) through (11) of Example IV were repeated.

12. Copper was applied using a strike bath of the instant invention (same as in Example XII).

13. A decorative copper electroplate was applied to the substrate (30 minutes, at 40 ASF (1.6 volts) in same bath as in Example I, Step (11)).

Results:

Same as Example XI.

EXAMPLE XIV

Example XII was repeated except that the copper strike in Step (12) was plated at 60 ASF (1.0 volts) rather than at 40 ASF.

Results:

Same as Example XI.

SUMMARY OF RESULTS OF EXAMPLES IX THROUGH XIV

Examples IX through XIV demonstrate the advantage of the copper strike of the instant invention when plated over either electroless nickel or electroless copper in that complete coverage of the panels was obtained. There were no bare spots where unplated plastic could be seen.

The importance of the increased conductivity of the electroplating solutions of the instant invention must be stressed since lower voltage requirements for any given current density results in less heat being generated because less power is dissipated at the contact points. It is desirable that the watts so generated be kept as low as possible so that the thermal tolerance of the thin electroless metal bridge is not exceeded.

The above may further be substantiated by ionic strength conductivity measurements of the solutions employed in the foregoing examples, along with the calculated conductivity of the system employed in the plating examples. All of the following conductivity measurements were made with a Model 31 Conductivity Bridge, manufactured by Yellow Springs Instrument Co., the electrical conductivity of the plating cell being calculated from the observed voltage and amperage in the foregoing examples, using the formula:

$$\text{Conductance (ohms)} = \frac{1}{\text{ohms}} = \frac{\text{amps}}{\text{volts}}$$

| | Measured Ionic Conductance | Calculated Cell Conductance |
|---|---|---|
| Decorative Acid Copper (25° C.) | 0.162 mhos | 2.25 mhos (1.6 volts, 36 amps) |
| Nickel sulfate-chloride solution (60° C.) | 0.086 mhos | 1.16 mhos (3.1 volts, 3.6 amps) |
| All nickel chloride sol'n (60° C.) | 0.117 mhos | 1.5 mhos (2.4 volts, 3.6 amps) |
| Copper strike of invention (25° C.) | 0.478 mhos | 4.5 mhos (0.8 volts, 3.6 amps) |

It is obvious that, in any given installation, the baths of the instant invention will exceed the baths of the prior art in conductivity by a factor of 2 to 3.

Most of the bath conductivity is obtained by the concentration of sulfuric acid and its degree of ionization. It was found, by decreasing the concentration of $H_2SO_4$ (in 30 cc/l increments) from 210 g/l, that "burn-off" was likely to occur in the area of 150 g/l (3.0 N) with a 90 g/l concentration of copper sulfate. Therefore, it was concluded, based on economy and ease of process control, that a conductivity maintained between 0.40 mhos to 0.60 mhos would be adequate for most operations.

The following conductivity measurements will show that the desired range could be achieved over a wide concentration range of the basic ingredients. The temperature in each case was 25° C.

| Conc. $H_2SO_4$ (in grams/l) | Conductivity with 45 g/l $CuSO_4$ (in mhos) | Conductivity with 90 g/l $CuSO_4$ (in mhos) | Conductivity with 120 g/l $CuSO_4$ |
|---|---|---|---|
| 60 | 0.200 | 0.188 | .159 |
| 90 | 0.289 | 0.285 | .224 |
| 120 | 0.385 | 0.330 | .269 |
| 150 | 0.420 | 0.380 | .315 |
| 180 | 0.522 | 0.442 | .351 |
| 210 | 0.558 | 0.478 | .393 |
| 240 | 0.585 | 0.528 | .409 |
| 270 | 0.617 | 0.555 | |
| 310 | 0.663 | 0.593 | |

*Preferred strike bath conductivity falls within boxed in area in table.

As can be seen, the degree of ionization of $H_2SO_4$ is affected by the increased copper sulfate concentration due to common ion effect. A desirable formulation, based on conductivity, would be one within the range of 45 to 90 g/l copper sulfate and 150 to 240 g/l sulfuric acid. The data also shows that the preferred concentration of 90 g/l copper sulfate and 210 g/l sulfuric acid is more desirable from an operational standpoint because, as the bath is weakened from drag-out losses and use, the desired conductivity will be more nearly maintained.

Such materials as sodium or magnesium sulfate, could be substituted for a portion of the sulfuric acid in order to obtain the desired conductivity. Copper chloride could be substituted for hydrochloric acid as the source of the chloride ion. Baths based on acids other than sulfuric acid, such as sulfamic acid and fluoroboric acid, would also be suitable, provided, such concentrations are employed that will give a desired level of conductivity. Traces of other copper compounds could also be added, but ions such as phosphate nitrate, fluoride, bromide, and acetate have a detrimental effect on copper deposition if used in any appreciable quantity.

While there have been described what are at present considered to be the preferred embodiments of this invention, it will be apparent to those skilled in the art that various changes and modifications may be made therein without departing from the invention, and it is, therefore, intended in the appended claims to cover all such changes and modifications as fall within the true spirit and scope of the invention.

What is claimed is:

1. A method for electrodepositing a thin, conductive layer of copper strike on a plastic substrate while avoiding burn-off so as to render it suitable to receive a continuous covering layer of electrolytically deposited copper which method comprises:

electrolessly depositing a thin layer of a metal selected from the group consisting of copper, nickel, cobalt and mixtures thereof on a surface of the plastic substrate;

positioning the plastic substrate on a supporting member, with the supporting member being in contact at a plurality of spaced apart electrical contact points with the substrate for the passage of electrical current therebetween;

immersing the substrate and its support in a copper strike bath in a manner such that all of said electrical contact points formed between said supporting member and said substrate are immersed in said bath, with said bath including from about 10.0 to about 45.0 g/l of copper ions, at least one acid selected from the group consisting of sulfuric acid, fluoroboric acid and sulfamic acid, with the acid being present in an amount sufficient to cause the electroplating bath to have a conductivity ranging from about 0.40 to about 0.60 mhos, and from about 30 to about 105 mg/l of chloride ions; and passing electrical current through the supporting member and the strike bath while said electrical contact points are immersed in said bath so as to cause a strike layer of copper to be electrolytically deposited over the layer of electrolessly deposited metal.

2. The method of claim 1 wherein said method comprises further including in said copper strike bath from about 1 to about 100 mg/l of a sulfonated sulfur-containing brightener and from about 0.1 to about 0.5 g/l of a nonionic wetting agent.

3. The method of claim 2 wherein said sulfur-containing compound is at least one compound selected from the group of compounds represented by the formula: $HO_3S$-R-SH (where R=$C_1$–$C_6$), $HO_3S$-R-S-S-R-$SO_3H$ (where R=$C_1$–$C_6$) and $HO_3S$-Ar-S-S-Ar$SO_3H$ (where Ar=phenyl or naphthyl).

4. The method of claim 2 wherein said nonionic wetting agent is selected from the group consisting of alkoxylated aliphatic hydroxy compounds, alkoxylated aromatic hydroxy compounds, and mixtures thereof.

5. The method of claim 1 wherein said acid is sulfuric acid.

6. The method of claim 1 wherein said sulfuric acid is present in an amount ranging from about 150 to 310 g/l.

7. The method of claim 1 wherein said strike bath contains from about 18 to about 36 g/l of copper.

8. The method of claim 1 wherein said step of electrolessly depositing a layer of metal on said substrate occurs prior to said step of positioning said plastic substrate on a supporting member.

9. The method of claim 1 wherein after the strike layer of copper has been electrolytically deposited over the layer of electrolessly deposited metal a decorative layer of metal is electrolytically deposited over the strike layer.

* * * * *